US008744842B2

(12) United States Patent
Cho

(10) Patent No.: US 8,744,842 B2
(45) Date of Patent: Jun. 3, 2014

(54) METHOD AND APPARATUS FOR DETECTING VOICE ACTIVITY BY USING SIGNAL AND NOISE POWER PREDICTION VALUES

(75) Inventor: Jae-youn Cho, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1200 days.

(21) Appl. No.: 12/127,942

(22) Filed: May 28, 2008

(65) Prior Publication Data

US 2009/0125305 A1 May 14, 2009

(30) Foreign Application Priority Data

Nov. 13, 2007 (KR) ..... 10-2007-0115503

(51) Int. Cl.
*G10L 25/93* (2013.01)
*G10L 21/00* (2013.01)
*G10L 25/90* (2013.01)

(52) U.S. Cl.
USPC ..... 704/208; 704/207; 704/206

(58) Field of Classification Search
None
See application file for complete search history.

(56) References Cited

U.S. PATENT DOCUMENTS 5,963,901 A * 10/1999 Vahatalo et al. ..... 704/233
6,088,670 A * 7/2000 Takada ..... 704/233
6,216,103 B1 * 4/2001 Wu et al. ..... 704/253
6,317,711 B1 * 11/2001 Muroi ..... 704/253
6,324,509 B1 * 11/2001 Bi et al. ..... 704/248
6,453,291 B1 * 9/2002 Ashley ..... 704/233
6,480,823 B1 * 11/2002 Zhao et al. ..... 704/226
6,574,601 B1 * 6/2003 Brown et al. ..... 704/270.1
6,823,303 B1 11/2004 Su et al.
2006/0287859 A1 * 12/2006 Hetherington et al. ..... 704/260

FOREIGN PATENT DOCUMENTS

KR 10-0593589 6/2006

OTHER PUBLICATIONS

International Telecommunication Union-T Recommendation, G.729—Annex B: A Silence Compression Scheme for G.729 Optimized for Terminal Conforming to Recommendation V.70 Series G: Transmission System and Media, Nov. 1996.

* cited by examiner

*Primary Examiner* — Jesse Pullias
(74) *Attorney, Agent, or Firm* — Stanzione & Kim, LLP

(57) ABSTRACT

A robust method and apparatus to detect voice activity based on the power level of an audio frame. The method may include performing primary active/non-active voice period determination of an input audio frame according to a power level of the audio frame, extracting a noise power prediction value and a signal power prediction value by referring to power levels of current and previous audio frames according to a primary active/non-active voice period determination value, and performing secondary active/non-active voice period determination for the input audio frame by comparing the extracted signal power prediction value with the extracted noise power prediction value.

19 Claims, 9 Drawing Sheets

FIG. 8A

| FRAME | i-2 | i-1 | i |
|---|---|---|---|
| DETERMINATION VALUE | ACTIVE VOICE | NON-ACTIVE VOICE | ACTIVE VOICE |
| | NON-ACTIVE VOICE | ACTIVE VOICE | NON-ACTIVE VOICE |

FIG. 8B

| FRAME | i-2 | i-1 | i |
|---|---|---|---|
| DETERMINATION VALUE | ACTIVE VOICE | ACTIVE VOICE | ACTIVE VOICE |
| | NON-ACTIVE VOICE | NON-ACTIVE VOICE | NON-ACTIVE VOICE |

METHOD AND APPARATUS FOR DETECTING VOICE ACTIVITY BY USING SIGNAL AND NOISE POWER PREDICTION VALUES

CROSS-REFERENCE TO RELATED APPLICATIONS

This application claims the benefit of Korean Patent Application No. 10-2007-0115503, filed on Nov. 13, 2007, in the Korean Intellectual Property Office, the disclosure of which is incorporated herein in its entirety by reference.

BACKGROUND OF THE INVENTION

1. Field of the Invention

The present general inventive concept generally relates to an audio processing system, and more particularly, to a robust method and apparatus to detect voice activity based on the power of an audio frame.

2. Description of the Related Art

Conventionally, voice activity extraction in voice coding uses voice activity detection (VAD) or end point detection (EPD).

A conventional voice activity detection method detects voice activity or start and end points of voice using the energy of each frame and the zero-crossing rate of the frame. For example, a period with speech (an active voice period) and a period without speech (a non-active voice period) are determined for each frame according to the zero-crossing rate of the frame.

When the active voice period and the non-active voice period are determined using the zero-crossing rate, noise may exist in the non-active voice period, and thus zero-crossing rates in the active voice period and the non-active voice period may not be equal at all times.

In other words, active/non-active voice period determination using the zero-crossing rate may involve noise having a zero-crossing rate that is similar to that of speech, as well as the speech as the active voice period. As a result, conventional active/non-active voice period determination using the zero-crossing rate may have errors because a zero-crossing rate may also occur in the non-active voice period.

Moreover, active/non-active voice period determination using the energy of a frame has difficulties in determining the active-voice period or the non-active voice period when using a fixed threshold when signals of different levels are input.

SUMMARY OF THE INVENTION

The present general inventive concept provides a robust method and apparatus to detect voice activity based on the power level of an audio frame, while being less affected by noise levels of the surrounding environment.

Additional aspects and/or utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a method of detecting voice activity, including performing primary active/non-active voice period determination of an input audio frame according to a power level of the audio frame, extracting a noise power prediction value and a signal power prediction value by referring to power levels of current and previous audio frames according to a primary active/non-active voice period determination value, and performing secondary active/non-active voice period determination of the input audio frame by comparing the extracted signal power prediction value with the extracted noise power prediction value.

The primary active/non-active voice period determination may include, determining if the input audio frame is a first frame, if the input audio frame is the first frame, determining the audio frame as an active voice period if a power of the audio frame is greater than a threshold power, and determining the audio frame as the non-active voice period if the power of the audio frame is less than the threshold power, if the input audio frame is not the first frame, determining the audio frame as the active voice period if the previous audio frame is the non-active voice period and the power of the current audio frame is greater than a predetermined multiple of the power of the previous audio frame, and if the previous audio frame is the active voice period and the power of the current audio frame is less than the predetermined multiple of the power of the previous audio frame, determining the audio frame as the non-active voice period.

The extraction of the noise power prediction value and the signal power prediction value may include, setting the threshold power to the noise power prediction value if the first audio frame is determined as the active voice period, and setting the power of the first audio frame to the noise power prediction value if the first audio frame is determined as the non-active voice period, if the input audio frame is not the first frame, determining if the input audio frame is determined as the active voice period or the non-active voice period, if the input audio frame is determined as the active voice period, updating the signal power prediction value by referring to levels of the current and previous audio frames, and if the input audio frame is determined as the non-active voice period, updating the noise power prediction value by referring to the levels of the current and previous audio frames.

The signal power prediction value may be an average value of signal powers of the current and previous frames stored in a buffer in a first-in first-out (FIFO) fashion.

The noise power prediction value may be an average of noise powers of the current and previous frames stored in a buffer in a first-in first-out (FIFO) fashion.

The secondary active/non-active voice period determination may include, determining the input audio frame as the active voice period if the signal power prediction value is greater than the noise power prediction value and determining the input audio frame as the non-active voice period if the signal power prediction value is less than the noise power prediction value.

The method of detecting voice activity may also include filtering the secondary active/non-active voice period determination value.

The foregoing and/or other aspects and utilities of the present general inventive concept may also be achieved by providing an apparatus of detecting voice activity, including a first active/non-active voice determination unit to perform primary active/non-active voice period determination of an input audio frame according to a power level of the audio frame, a frame power prediction unit to update a noise power prediction value and a signal power prediction value by referring to power levels of current and previous audio frames according to a primary active/non-active voice period determination value, and a secondary active/non-active voice determination unit to perform secondary active/non-active voice period determination of the input audio frame by comparing the signal power prediction value with the noise power prediction value.

The primary active/non-active voice determination unit may include a flag to determine the primary active/non-active voice period determination according to the power level of the audio frame.

The foregoing and/or other aspects and utilities of the present general inventive concept may also be achieved by providing a method of detecting voice activity, the method including determining audio frames as active voice periods or non-active voice periods according to a power level of the audio frames, respectively, setting a signal power prediction value or a noise power prediction value of a current audio frame based on the determining audio frames as active/non-active voice periods and in accordance with the power levels of the current and/or previous audio frames, if the signal power prediction value is greater than the noise power prediction value, re-determining the current audio frame as the active voice period, and if the signal power prediction value is less than the noise power prediction value, re-determining the current audio frame as the non-active voice period.

The method of detecting voice activity may also include filtering the respective re-determination values using median filtering, removing the re-determination values when the difference between the power levels of current and previous audio frames is greater than a predetermined value, and determining the current audio frame as a final active voice period or a final non-active voice period based on the filtered values.

The foregoing and/or other aspects and utilities of the present general inventive concept may also be achieved by providing a method of determining active voice periods and non-active voice periods of audio frames, the method including determining if an input audio frame is a first audio frame, if the input audio frame is the first audio frame and the power level of the first audio frame is greater than a threshold power level, determining the first audio frame as the active voice period, otherwise, determining the first audio frame as the non-active voice period, if the input audio frame is not the first audio frame and the input audio frame is the non-active voice period and the power level of the input audio frame is greater than a predetermined multiple of the power level of a previous audio frame, determining the input audio frame as the active voice period, and if the input audio frame is not the first audio frame and the input audio frame is the active voice period and the power level of the input audio frame is less than the predetermined multiple of the power level of the previous audio frame, determining the input audio frame as the non-active voice period.

The method of determining active voice periods and non-active voice periods of audio frames may also include setting one of a signal power prediction value and a noise power prediction value of a current audio frame based on the active/non-active voice period determination and in accordance with the power levels of the current and/or previous audio frames, if the signal power prediction value is greater than the noise power prediction value, re-determining the current audio frame as the active voice period, and if the signal power prediction value is less than the noise power prediction value, re-determining the current audio frame as the non-active voice period.

The method of determining active voice periods and non-active voice periods of audio frames may also include removing the re-determination values when the difference between the power levels of current and previous audio frames is greater than a predetermined value, and determining the current audio frame as a final active voice period or a final non-active voice period based on the power level difference.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which:

FIGS. 8A and 8B are graphs illustrating examples of filtering of active/non-active voice determination values.

DETAILED DESCRIPTION OF THE PREFERRED EMBODIMENTS

Figure 1A:
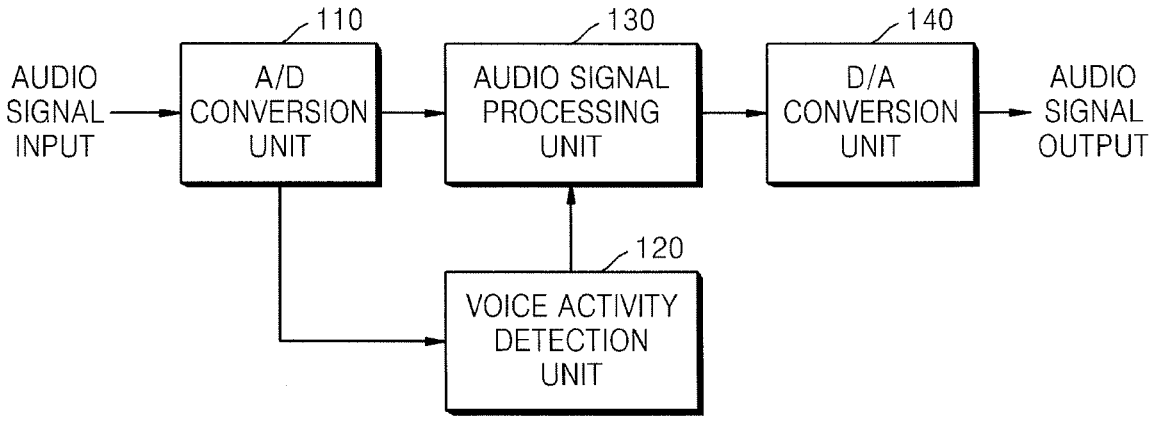
FIGS. 1A and 1B are block diagrams of an audio processing system having a voice activity detection function, according to embodiments of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 1B:
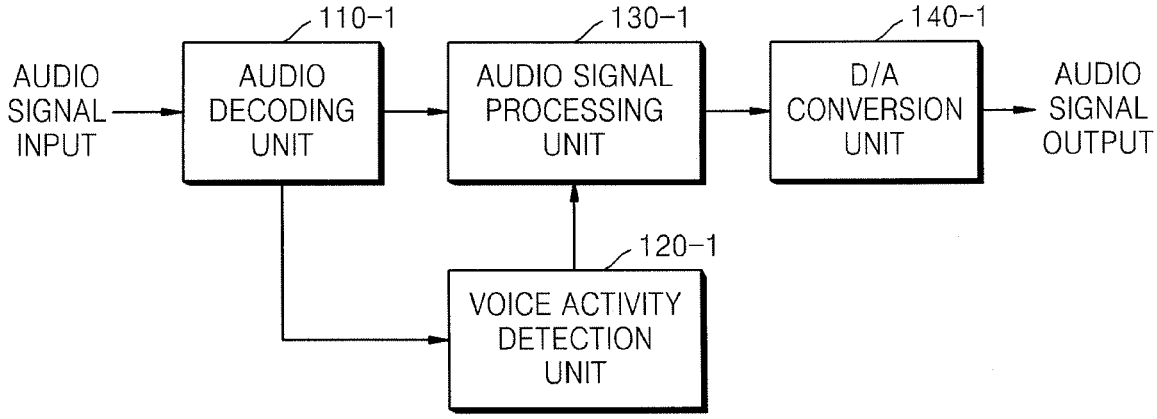

FIGS. 1A and 1B are block diagrams of audio processing systems having a voice activity detection function, according to embodiments of the present general inventive concept.

FIG. 1A is a block diagram of an audio processing system to process an analog audio signal input.

Referring to FIG. 1A, the analog audio processing system may include an analog-to-digital (A/D) conversion unit 110, a voice activity detection unit 120, an audio signal processing unit 130, and a digital-to-analog (D/A) conversion unit 140.

The A/D conversion unit 110 can convert an input analog audio signal into a digital audio signal, and can provide the converted digital audio signal to the audio signal processing unit 130 and the voice activity detection unit 120.

The voice activity detection unit 120 can perform primary active/non-active voice period determination for an audio frame output from the A/D conversion unit 110 according to a power of the audio frame, can extract a noise power prediction value and a signal power prediction value by referring to the powers of current and previous audio frames according to a primary active/non-active voice period determination value (result), and can perform secondary active/non-active voice period determination for the current audio frame by comparing the extracted signal power prediction value with the extracted noise power prediction value.

The audio signal processing unit 130 can perform voice coding and voice recognition according to active/non-active voice period information detected by the voice activity detection unit 120.

The D/A conversion unit 140 can convert the digital audio signal processed by the audio signal processing unit 130 into an analog audio signal.

FIG. 1B is a block diagram of the audio processing system for a digital audio signal input.

Referring to FIG. 1B, the audio processing system may include an audio decoding unit 110-1, a voice activity detection unit 120-1, an audio signal processing unit 130-1, and a D/A conversion unit 140-1.

The audio decoding unit 110-1 can decode compressed digital audio data according to a predetermined decoding algorithm.

The voice activity detection unit 120-1, the audio signal processing unit 130-1, and the D/A conversion unit 140-1 can function in the same way respectively as the voice activity detection unit 120, the audio signal processing unit 130, and the D/A conversion unit 140 illustrated in FIG. 1A, and thus, a description thereof will not be repeated.

Figure 2:
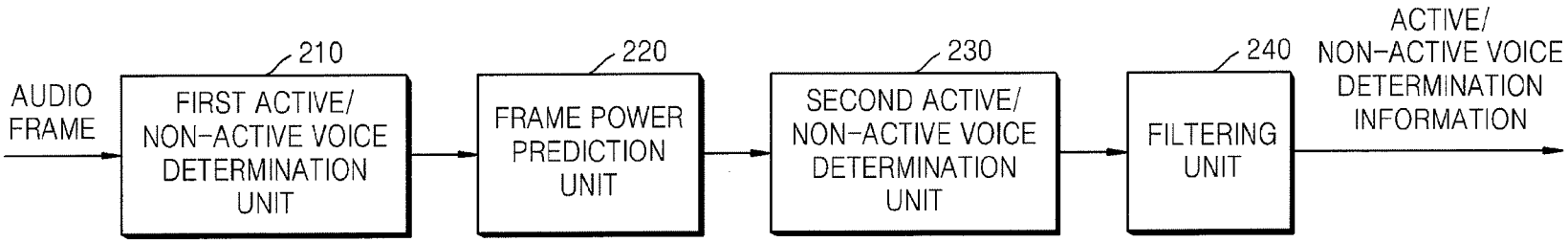
FIG. 2 is a detailed block diagram of a voice activity detection unit illustrated in FIG. 1A or 1B.

FIG. 2 is a detailed block diagram of the voice activity detection unit 120 illustrated in FIG. 1A or the voice activity detection unit 120-1 illustrated in FIG. 1B.

Referring to FIG. 2, the voice activity detection unit 120 or 120-1 may include a first active/non-active voice determination unit 210, a frame power prediction unit 220, a second active/non-active voice determination unit 230, and a filtering unit 240.

The first active/non-active voice determination unit 210 can perform primary active/non-active voice period determination for the audio frame using a flag determined according to a power of the audio frame. For flag determination, the flag may be determined as "1" if a power of the audio frame is greater than a threshold power, and the flag may be determined as "0" if the power of the audio frame is less than the threshold power. The threshold power may be set to a value for which sound cannot be heard by a human or may be an arbitrary low level (or power).

The frame power prediction unit 220 can update the noise power prediction value and the signal power prediction value by referring to powers of the current and previous audio frames, which are stored in a first-in first-out (FIFO) buffer, according to the primary active/non-active voice period determination value. For example, for a flag of "1", the signal power prediction value can be calculated as an average value of the powers of the current and previous audio frames stored in the FIFO buffer. For a flag of "0", the noise power prediction value can be calculated as an average of the powers of the current and previous audio frames stored in the FIFO buffer.

The second active/non-active voice determination unit 230 can perform secondary active/non-active voice period determination for the current audio frame by comparing the extracted signal power prediction value with the extracted noise power prediction value. For example, the second active/non-active voice determination unit 230 can determine the current audio frame as an active voice period if the signal power prediction value is greater than the noise power prediction value, and can determine the current audio frame as a non-active voice period if the signal power prediction value is less than the noise power prediction value.

The filtering unit 240 can filter secondary active/non-active voice period determination values using a media filter. The filtering unit 240 can reduce the possibility of a wrong active voice/non-active determination due to consecutive changes between frames.

Figure 3:
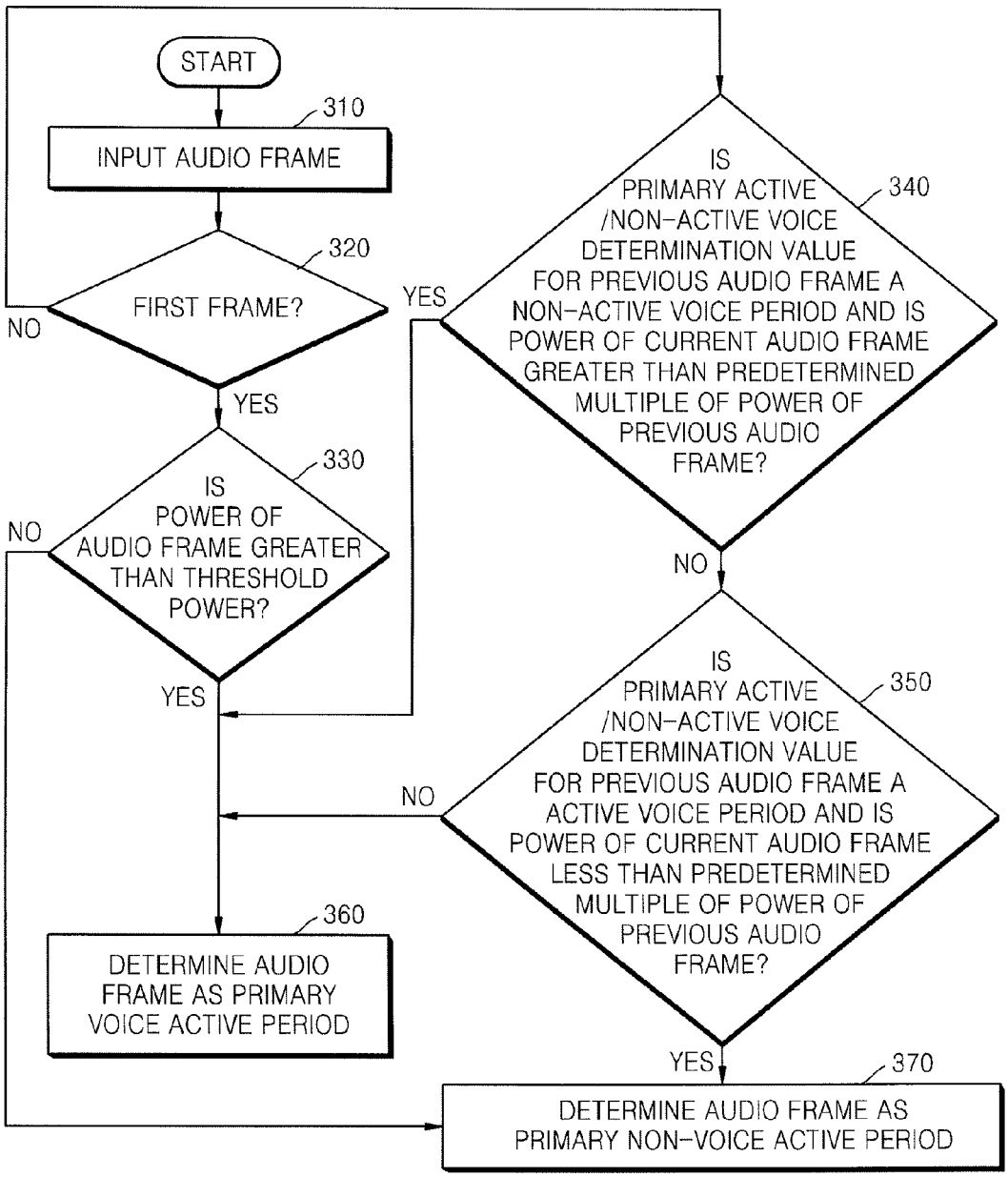
FIG. 3 is a detailed flowchart illustrating an operation of a first active/non-active voice determination unit illustrated in FIG. 2.

FIG. 3 is a detailed flowchart illustrating the operation of the first active/non-active voice determination unit 210 illustrated in FIG. 2.

In operation 310, the first active/non-active voice determination unit 210 can read a predetermined number of samples from an input audio frame in order to obtain a power Pi of an $i^{th}$ frame, where i is a natural number.

In operation 320, the first active/non-active voice determination unit 210 can determine if the input audio frame is the first frame by referring to frame information.

In operation 330, if it is determined that the input audio frame is the first frame, the first active/non-active voice determination unit 210 determines if a power of the first audio frame is greater than a predetermined threshold power.

In operation 360, if it is determined that the power of the first audio frame is greater than the threshold power, the first active/non-active voice determination unit 210 determines the audio frame as an active voice period, in operation 360. Otherwise, if it is determined that the power of the first audio frame is not greater than the threshold power, the first active/non-active voice determination unit 210 determines the audio frame as a non-active voice period, in operation 370. At this time, the primary active/non-active voice period determination can be performed by using a flag determined according to a power of the audio frame with respect to the threshold power. Otherwise, if the input audio frame is not the first frame, in operation 320, the first active/non-active voice determination unit 210 performs active/non-active voice period detection for the following audio frames by using the primary active/non-active voice determination value.

In other words, if the primary active/non-active voice determination value for the first audio frame or a previous audio frame is a non-active voice period and a power of the current audio frame is greater than a predetermined multiple of the power of the previous audio frame, in operation 340, the first active/non-active voice determination unit 210 determines the current audio frame as the active voice period, in operation 360.

If the primary active/non-active voice determination value for the first audio frame or the previous audio frame is an active voice period and the power of the current audio frame is less than the predetermined multiple of the power of the previous audio frame, in operation 350, the first active/non-active voice determination unit 210 determines the current audio frame as the non-active voice period, in operation 370.

Figure 4:
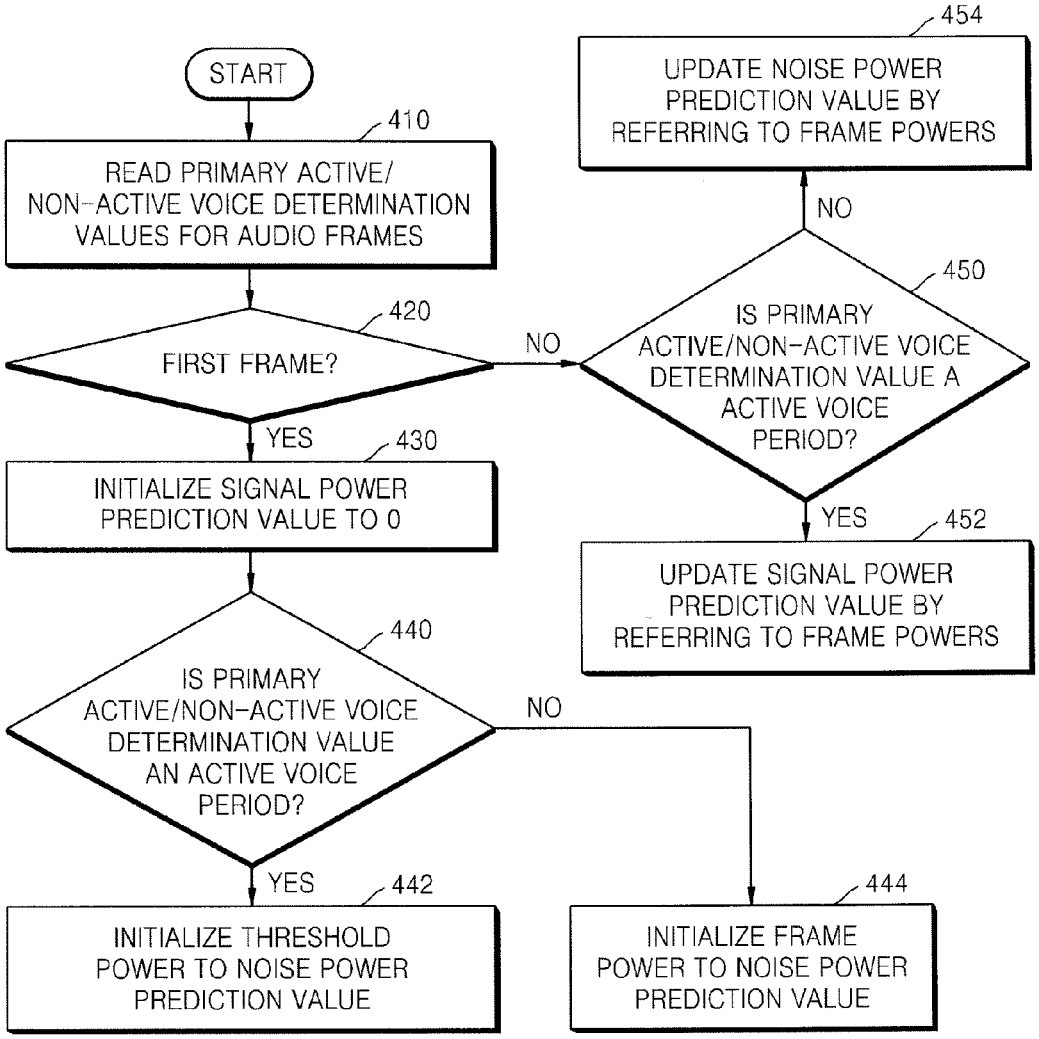
FIG. 4 is a detailed flowchart illustrating an operation of a frame power prediction unit illustrated in FIG. 2.

FIG. 4 is a detailed flowchart illustrating the operation of the frame power prediction unit 220 illustrated in FIG. 2.

In operation 410, the frame power prediction unit 220 can read primary active/non-active voice determination values for audio frames stored in a memory.

In operation 420, the frame power prediction unit 220 can determine if an input audio frame is the first audio frame by referring to frame information.

If the input audio frame is the first audio frame, in operation 420, the frame power prediction unit 220 initializes a signal power prediction value as "0", in operation 430, and determines if the primary active/non-active voice determination value for the first audio frame is an active voice period, in operation 440. If the primary active/non-active voice determination value for the first audio frame is determined as the active voice period, in operation 440, it means that a voice level (or power) of the first audio frame is greater than a noise level, and thus, the frame power prediction unit 220 initializes the threshold power to a noise power prediction value, in operation 442. Otherwise, if the primary active/non-active voice determination value for the first audio frame is determined as the non-active voice period, in operation 440, the frame power prediction unit 220 initializes the power of the first audio frame to the noise power prediction value, in operation 444.

Otherwise, if the input audio frame is not the first frame, in operation 420, the frame power prediction unit 220 predicts a power change in the voice and noise of the following audio frames.

In other words, if the primary active/non-active voice determination value for the current input audio frame is determined as an active voice period (e.g., flag=1), in operation 450, the frame power prediction unit 220 updates the signal power prediction value with an average value of powers (or levels) of the current and previous audio frames stored in an FIFO buffer to predict the signal, in operation 452. For example, the signal power prediction value can be an average value of P1, P2, P3, P4, . . . , PN where N is a natural number and indicates the number of frames constituting the FIFO buffer. However, if the primary active/non-active voice determination value for the current input audio frame is determined as a non-active voice period (e.g., flag=0), in operation 450, the frame power prediction unit 220 updates the noise power prediction value with an average of the powers (or levels) of the current and previous audio frames stored in another FIFO buffer to predict the noise level, in operation 454.

Figure 5:
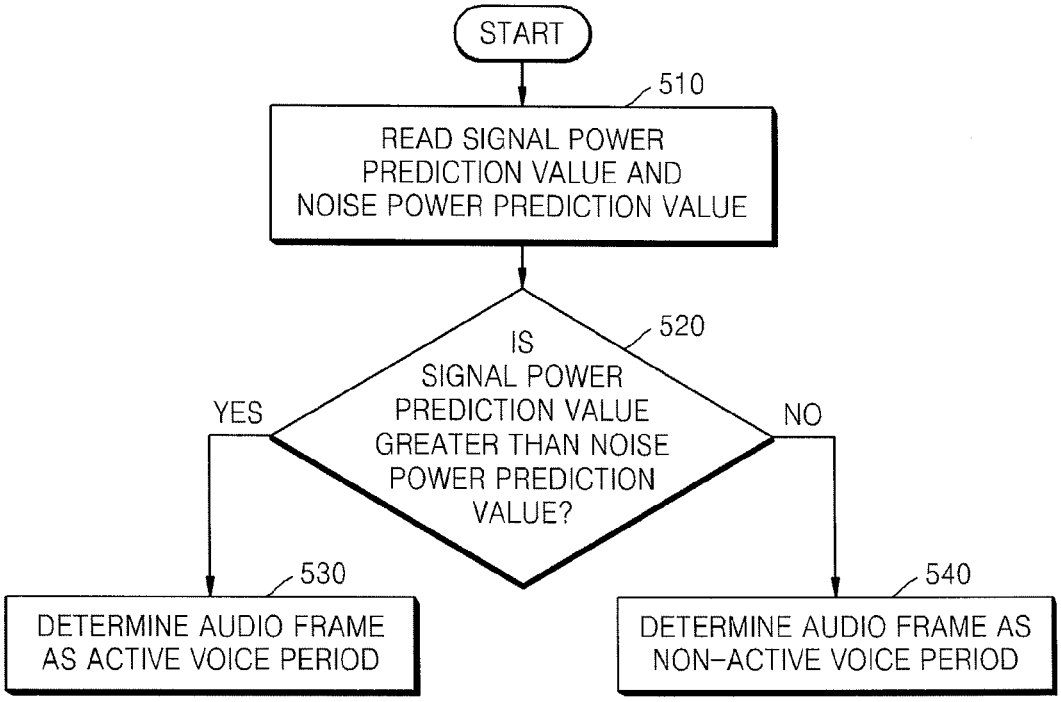
FIG. 5 is a detailed flowchart illustrating an operation of a second active/non-active voice determination unit illustrated in FIG. 2.

FIG. 5 is a detailed flowchart illustrating an operation of the second active/non-active voice determination unit 230 illustrated in FIG. 2.

In operation 510, the second active/non-active voice determination unit 230 can read the signal power prediction value and the noise power prediction value stored in the FIFO buffers.

In operation 520, the second active/non-active voice determination unit 230 can compare the signal power prediction value with the noise power prediction value, and if the signal power prediction value is greater than the noise power prediction value, the second active/non-active voice determination unit 230 can determine the current audio frame as the active voice period, in operation 530. Otherwise, if the signal power prediction value is less than the noise power prediction value, the second active/non-active voice determination unit 230 can determine the current audio frame as the non-active voice period in operation 540.

Figure 6:
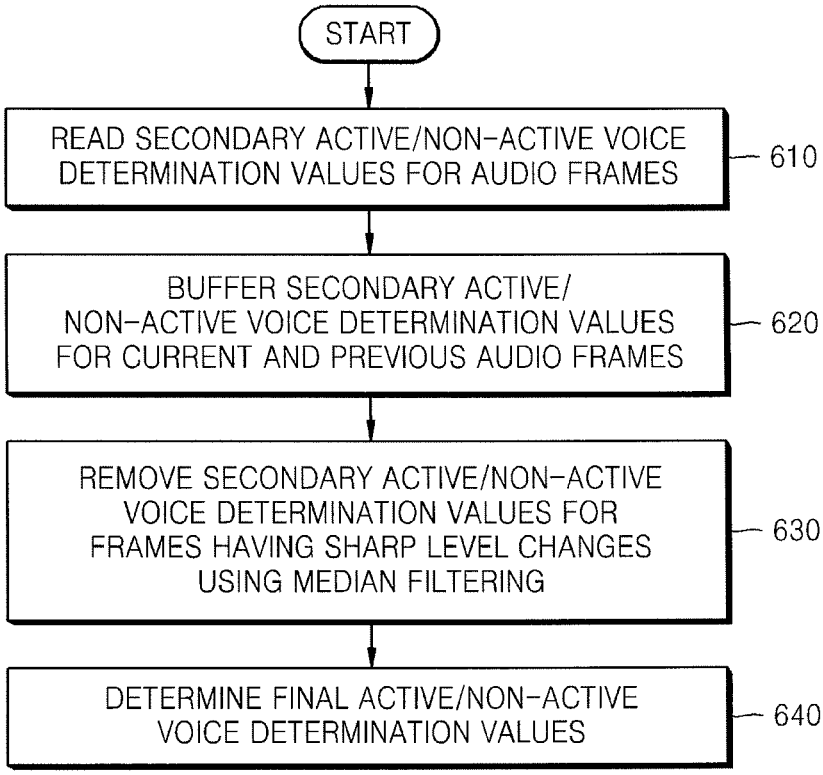
FIG. 6 is a detailed flowchart illustrating an operation of a filtering unit illustrated in FIG. 2.

FIG. 6 is a detailed flowchart illustrating the operation of the filtering unit 240 illustrated in FIG. 2.

In operation 610, the filtering unit 240 can read secondary active/non-active voice determination values for audio frames stored in the FIFO buffer.

In operation 620, the filtering unit 240 can buffer secondary active/non-active voice determination values for current and previous frames.

In operation 630, the filtering unit 240 can remove secondary active/non-active voice determination values for frames having sharp level changes by smoothing the read secondary active/non-active voice determination values using a median filter.

In operation 640, the filtering unit 240 can determine final active/non-active voice determination values from the smoothed secondary active/non-active voice determination values.

FIGS. 7A through 7D are graphs illustrating waveforms and powers of an audio signal to demonstrate voice activity detection, according to an embodiment of the present general inventive concept.

Figures 7A, 7B:
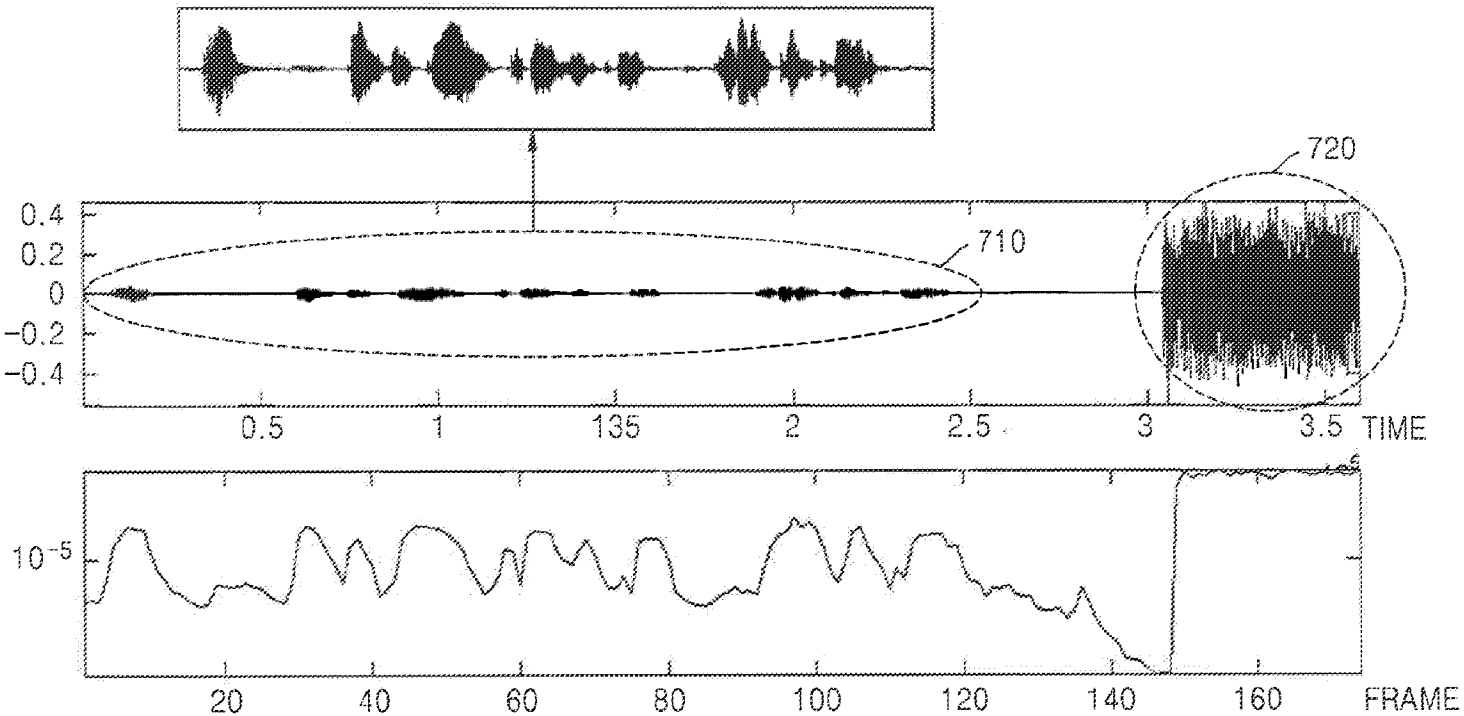
FIGS. 7A through 7D are graphs illustrating waveforms and powers of an audio signal to illustrate voice activity detection, according to an embodiment of the present general inventive concept.

Referring to FIG. 7A, there is illustrated a pair of analog audio signals 710 and 720 for use in performing voice activity detection operations.

Here, the power level of signal 710 is much different from that of signal 720.

FIG. 7B is a graph illustrating respective power levels corresponding to the signal waveforms 710 and 720 illustrated in FIG. 7A. The analog signals 710 and 720 of FIG. 7A can be input to the A/D conversion unit 110 of the audio processing system of FIG. 1A to detect voice activity of the audio signals.

One drawback of conventional detection systems is that when the audio signals 710 and 720 having different power levels are input to the audio processing system, it is difficult to determine an active/non-active voice period using a fixed threshold power. By comparison, as further described below, the present general inventive concept can provide a flexible (i.e., updated) noise power prediction value and signal power prediction value to assist performance of the active/non-active voice determination, regardless of a signal level or noise of the audio signal.

Figure 7C:
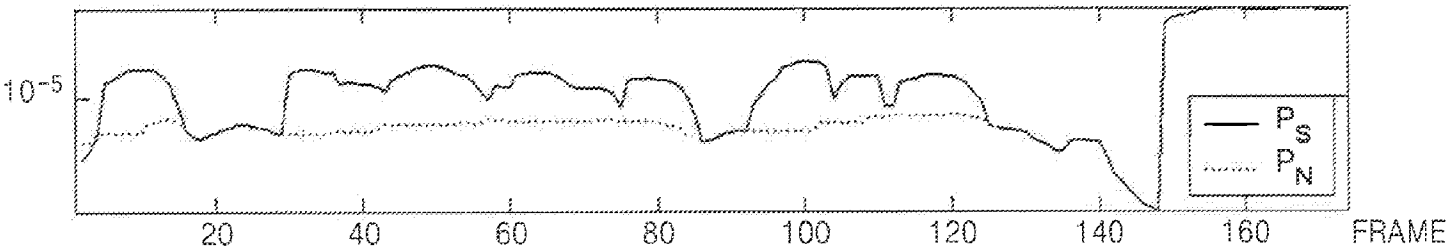

FIG. 7C is a graph illustrating a signal power Ps and a noise power Pn of signals illustrated in FIG. 7A.

Referring to FIG. 7C, the signal power Ps (solid line) and the noise power Pn (dotted line) are compared with each other.

Figure 7D:
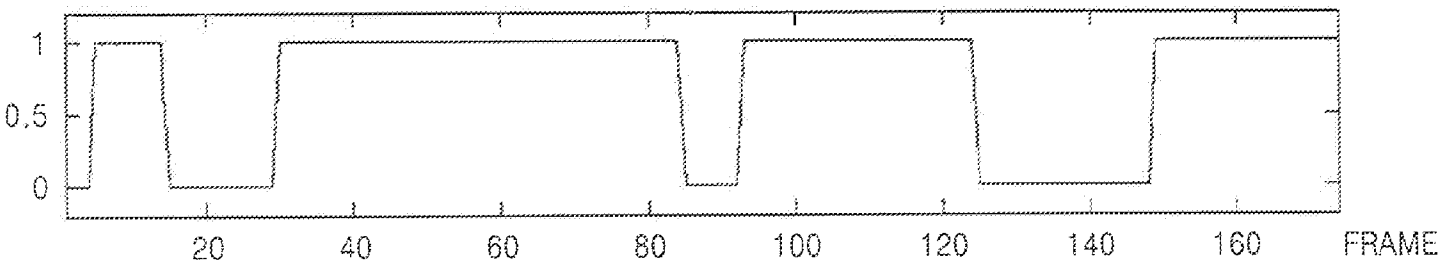

Referring to FIG. 7D, by comparing the signal power Ps with the noise power Pn, an active/non-active voice period can be correctly determined regardless of a signal level or noise. For example, if the signal power Ps is greater than the noise power Pn, a corresponding frame is set to an active/non-active voice determination value corresponding to an active voice period, e.g., "1". Otherwise, if the signal power Ps is less than the noise power Pn, the frame is set to an active/non-active voice determination value corresponding to a non-active voice period, e.g., "0".

FIGS. 8A and 8B are graphs illustrating examples of filtering of active/non-active voice determination values.

Referring to FIG. 8A, consecutive periods between frames in which voice activity changes, e.g., "active voice", "non-active voice", "active voice", may be determined incorrectly in terms of being an active/non-active voice period.

Thus, by smoothing "active voice", "non-active voice", and "active voice" respectively into "active voice", "active voice", and "active voice" using a median filter, the probability of a wrong active/non-active voice determination caused by noise can be reduced, as illustrated in FIG. 8B.

As described above, according to the present general inventive concept, an active/non-active voice period can be determined simply by calculating a power of a frame, thereby reducing the amount of calculations and improving the accuracy of an active/non-active voice determination.

Moreover, by comparing a signal power prediction value with a noise power prediction value, an active/non-active voice period can be effectively determined with a low-level signal.

The present general inventive concept can also be embodied as computer-readable codes on a computer-readable medium. The computer-readable medium can include a computer-readable recording medium and a computer-readable transmission medium. The computer-readable recording medium is any data storage device that can store data which can be thereafter read by a computer system. Examples of computer-readable recording media include read-only memory (ROM), random-access memory (RAM), CD-ROMs, magnetic tapes, floppy disks, optical data storage devices. The computer-readable recording medium can also be distributed over a network of coupled computer systems so that the computer-readable code is stored and executed in a decentralized fashion. The computer-readable transmission medium can transmit carrier waves and signals (e.g., wired or wireless data transmission through the Internet). Also, functional programs, codes, and code segments to accomplish the present general inventive concept can be easily construed by programmers skilled in the art to which the present general inventive concept pertains.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A method of detecting voice activity, the method comprising:

performing primary active/non-active voice period determination of an input audio frame according to a power level of a current audio frame to generate a primary active/non-active voice period determination value indicating whether the current audio frame has an active or non-active voice period;

extracting a noise power prediction value and a signal power prediction value of the input audio frame by referring to power levels of current and previous audio frames according to the primary active/non-active voice period determination value;

performing secondary active/non-active voice period determination of the input audio frame by comparing the extracted signal power prediction value with the extracted noise power prediction value; and filtering the secondary active/non-active voice period determination values to smooth consecutive periods between frames in which the active/non-active voice change.

2. The method of claim 1, wherein the primary active/non-active voice period determination comprises:

determining if the input audio frame is a first frame;

if the input audio frame is the first frame, determining the current audio frame as an active voice period if a power of the current audio frame is greater than a threshold power, and determining the current audio frame as the non-active voice period if the power of the current audio frame is less than the threshold power;

if the input audio frame is not the first frame, determining the current audio frame as the active voice period if the previous audio frame is the non-active voice period and the power of the current audio frame is greater than a predetermined multiple of the power of the previous audio frame; and if the previous audio frame is the active voice period and the power of the current audio frame is less than the predetermined multiple of the power of the previous audio frame, determining the current audio frame as the non-active voice period.

3. The method of claim 2, wherein the extraction of the noise power prediction value and the signal power prediction value comprises:

setting the threshold power to the noise power prediction value if the first audio frame is determined as the active voice period, and setting the power of the first audio frame to the noise power prediction value if the first audio frame is determined as the non-active voice period;

if the input audio frame is not the first frame, determining if the input audio frame is determined as the active voice period or the non-active voice period;

if the input audio frame is determined as the active voice period, updating the signal power prediction value by referring to levels of the current and previous audio frames; and if the input audio frame is determined as the non-active voice period, updating the noise power prediction value by referring to the levels of the current and previous audio frames.

4. The method of claim 3, wherein the signal power prediction value is an average value of signal powers of the current and previous frames stored in a buffer in a first-in first-out (FIFO) fashion.

5. The method of claim 3, wherein the noise power prediction value is an average of noise powers of the current and previous frames stored in a buffer in a first-in first-out (FIFO) fashion.

6. The method of claim 3, wherein the signal power prediction value is initialized to zero if the input audio frame is the first frame.

7. The method of claim 2, further comprising:

if the previous audio frame is the non-active voice period and the power of the current audio frame is less than the predetermined multiple of the power of the previous audio frame, or if the previous audio frame is the active voice period and the power of the current audio frame is greater than the predetermined multiple of the power of the previous audio frame, determining the input audio frame as the active voice period.

8. The method of claim 2, wherein the threshold power is set to a value for which sound cannot be heard by a human.

9. The method of claim 1, wherein the secondary active/non-active voice period determination comprises determining the input audio frame as the active voice period if the signal power prediction value is greater than the noise power prediction value and determining the input audio frame as the non-active voice period if the signal power prediction value is less than the noise power prediction value.

10. An apparatus to detect voice activity, the apparatus comprising:

a first active/non-active voice determination unit to perform primary active/non-active voice period determination of an input audio frame according to a power level of a current audio frame to generate a primary active/non-active voice period determination value indicating whether the current audio frame has an active or non-active voice period;

a frame power prediction unit to update a noise power prediction value and a signal power prediction value by referring to power levels of current and previous audio frames according to the primary active/non-active voice period determination value, where the update of the noise power prediction value and the signal power prediction value comprises a threshold power that is set to the noise power prediction value if a first audio frame is determined as the active voice period, and a power of the first audio frame that is set to the noise power prediction value if the first audio frame is determined as the non-active voice period; and a secondary active/non-active voice determination unit to perform secondary active/non-active voice period determination of the input audio frame by comparing the signal power prediction value with the noise power prediction value.

11. The apparatus of claim 10, wherein the primary active/non-active voice determination unit comprises a flag to determine the primary active/non-active voice period determination according to the power level of the current audio frame.

12. The apparatus of claim 10, further comprising a filtering unit to filter the secondary active/non-active voice period determination value.

13. The apparatus of claim 12, wherein the filtering unit is a median filter.

14. The apparatus of claim 10, wherein, if the audio frame is the first audio frame, the frame power prediction unit is configured to:

initialize the signal power prediction value as zero.

15. The apparatus of claim 10, if the audio frame is not the first audio frame, the frame power prediction unit is configured to:

update the signal power prediction value by referring to the power levels of the current and previous audio frames if the audio frame is determined as the active voice period; and update the noise power prediction value by referring to the power levels of the current and previous audio frames if the audio frame is determined as the non-active voice period.

16. An audio processing device comprising:

a voice activity detection unit to perform primary active/non-active voice period determination of an input audio frame according to a power level of a current audio frame to generate a primary active/non-active voice period determination value indicating whether the current audio frame has an active or non-active voice period, extracting a noise power prediction value and a signal power prediction value according to the primary active/non-active voice period determination value wherein the extracting of the noise power prediction value and the signal power prediction value comprises setting a threshold power to the noise power prediction value if a first audio frame is determined as the active voice period, and setting a power of the first audio frame to the noise power prediction value if the first audio frame is determined as the non-active voice period, and performing secondary active/non-active voice period determination of the input audio frame by comparing the extracted signal power prediction value with the extracted noise power prediction value; and an audio signal processing unit to perform voice coding and voice recognition according to active/non-active voice period information detected by the voice activity detection unit.

17. A non-transitory computer-readable recording medium having recorded thereon a program to execute a method of detecting voice activity, the method comprising:

performing primary active/non-active voice period determination of an input audio frame according to a power level of a current audio frame to generate a primary active/non-active voice period determination value indicating whether the current audio frame has an active or non-active voice period;

extracting a noise power prediction value and a signal power prediction value by referring to power levels of current and previous audio frames according to the primary active/non-active voice period determination value where the extracting of the noise power prediction value and the signal power prediction value comprises setting a threshold power to the noise power prediction value if a first audio frame is determined as the active voice period, and setting a power of the first audio frame to the noise power prediction value if the first audio frame is determined as the non-active voice period; and performing secondary active/non-active voice period determination of the input audio frame by comparing the extracted signal power prediction value with the extracted noise power prediction value.

18. A method of detecting voice activity, the method comprising:

determining audio frames as active voice periods or non-active voice periods according to a power level of the audio frames, respectively;

setting a signal power prediction value or a noise power prediction value of a current audio frame based on whether the current audio frame of the audio frames is determined as an active voice period or a non-active voice period and according to power levels of the current and/or previous audio frames where the setting of the signal power prediction value or the noise power prediction value comprises setting a threshold power to the noise power prediction value if a first audio frame is determined as the active voice period, and setting a power of the first audio frame to the noise power prediction value if the first audio frame is determined as the non-active voice period;

if the signal power prediction value is greater than the noise power prediction value, re-determining the current audio frame as the active voice period; and if the signal power prediction value is less than the noise power prediction value, re-determining the current audio frame as the non-active voice period.

19. The method of claim 18, further comprising:

filtering the respective re-determination values using median filtering;

removing the re-determination values when the difference between the power levels of current and previous audio frames is greater than a predetermined value; and determining the current audio frame as a final active voice period or a final non-active voice period based on the filtered values.

* * * * *